US007562609B2

(12) United States Patent
Ueno

(10) Patent No.: US 7,562,609 B2
(45) Date of Patent: Jul. 21, 2009

(54) METHOD OF FORMING THROUGH-HOLE AND THROUGH-HOLE FORMING MACHINE

(76) Inventor: Eizou Ueno, 5-9, Sumisaka 5-chome, Suzaka-shi, Nagano 382-0099 (JP)

( * ) Notice: Subject to any disclaimer, the term of this patent is extended or adjusted under 35 U.S.C. 154(b) by 295 days.

(21) Appl. No.: 11/287,204

(22) Filed: Nov. 28, 2005

(65) Prior Publication Data

US 2006/0137499 A1 Jun. 29, 2006

(30) Foreign Application Priority Data

Dec. 27, 2004 (JP) ..... 2004-375191

(51) Int. Cl.
*B23D 21/14* (2006.01)
*B21D 31/02* (2006.01)

(52) U.S. Cl. ..... 83/178; 83/191; 83/30; 83/684; 83/54; 72/327

(58) Field of Classification Search ..... 83/30, 83/54, 53, 22, 177, 39, 684, 191, 178, 613, 83/639.2, 188, 685, 686; 72/55, 58, 336, 72/327; 29/421.1

See application file for complete search history.

(56) References Cited

U.S. PATENT DOCUMENTS 5,460,026 A * 10/1995 Schafer ..... 72/55
5,666,840 A 9/1997 Shah et al.
6,032,559 A * 3/2000 Dean, Jr. ..... 83/191
6,186,696 B1 * 2/2001 Valin ..... 403/306

FOREIGN PATENT DOCUMENTS

| | | | |
|---|---|---|---|
| DE | 004320043 | A1 * | 9/1994 |
| DE | 43 20 043 | A1 | 12/1994 |
| DE | 195 13 519 | A1 | 5/1996 |
| EP | 0 726 824 | B1 | 7/1998 |
| JP | 5-42330 | A | 2/1993 |

* cited by examiner

*Primary Examiner*—Ghassem Alie
(74) *Attorney, Agent, or Firm*—Muncy, Geissler, Olds & Lowe, PLLC

(57) ABSTRACT

The method of forming a through-hole is capable of preventing formation of burrs, improving machining efficiency and reducing machining cost. The method of forming a through-hole in a circular wall of a cylindrical part of a work piece comprises the steps of: setting the work piece to a die; inserting a punch, which is provided to a rod-shaped metal core, into the cylindrical part; and pressing and moving a press pin toward the die together with the punch so as to drive the punch into an inner face of the circular wall and bore the through-hole. The press pin is inserted in the cylindrical part via a guide through-hole, which has been formed in the circular wall of the work piece and which is located on the opposite side of a prescribed position corresponding to the through-hole to be bored, and contacts a surface of the metal core, which is located on the opposite side of the punch.

8 Claims, 18 Drawing Sheets

METHOD OF FORMING THROUGH-HOLE AND THROUGH-HOLE FORMING MACHINE

BACKGROUND OF THE INVENTION

The present invention relates to a method of forming a through-hole or through-holes and a through-hole forming machine, more precisely relates to a method of forming a through-hole or through-holes in a circular wall of a cylindrical part of a work piece and a through-hole forming machine capable of performing the method.

Conventionally, through-holes are formed in work pieces by drill means, die-punch press means, electric spark means, etc. To form a through-hole in a circular wall of a cylindrical part of a work piece, e.g., pipe, the above described means have been used.

However, by using the drill means an the press means, burrs are formed along edges of through-holes, so they must be removed. Especially, in case of forming a thorough-hole from an outer face of the cylindrical part by the drill means or the press means, burrs are formed along an inner edge of the through-hole. In some cases, inner burrs must be removed. If the work piece is small, it is difficult to remove burrs formed in the cylindrical part of the work piece. Further, in some work pieces, it is impossible to remove inner burrs.

Conventionally, in case of forming a through-hole in a relatively thick circular wall of a cylindrical part of a work piece, the electric spark means has been used. However, it takes a long time to form the through-hole by the electric spark means, so manufacturing efficiency must be lower. Further, machining cost must be increased.

Further, in case of boring a relatively large through-hole in a small work piece, the through-hole is bored by driving a punch into an outer face of a cylindrical part, and inner burrs are manually removed in a following step. In this case too, manufacturing efficiency must be lower, and machining cost must be increased.

In the mean time, a through-hole can be formed in a flat work piece by the press means as shown in FIGS. 20(*a*) and 20(*b*). The method is disclosed in Japanese Patent Gazette No. 5-42330 (paragraphs [0005], [0006], [0009] and [0019]).

In the method, circular grooves 174*a*, which correspond to an edge of a through-hole 170*a* to be formed, is previously formed in at least a bottom face of a flat work piece 107*b*, then a pierce punch 151*a*, which is arranged to correspond to the circular grooves 174*a*, is driven into the work piece 107*b*, so that the through-hole 170*a* can be bored. Note that, a symbol 178*a* stands for a scrap, which is a part of the work piece 107*a* separated by boring the through-hole 170*a*.

However, in the method shown in FIGS. 20(*a*) and 20(*b*), the punch 151*a* is merely driven into a die 151*b* from an upper side. This method cannot be applied to form a through-hole in a circular wall of a cylindrical part of a small work piece.

Thus, workers have tried to bore a through-hole, by a punch, from the inside of the cylindrical part so as not to form burrs therein. However, a small punch, which can be inserted into the cylindrical part, is required, and a span of life of the punch must be short. Namely, there is no punches having such function.

Further, in case of oppositely boring through-holes in the circular wall of the cylindrical part of the work piece, there are no suitable method and no suitable through-hole forming machine.

SUMMARY OF THE INVENTION

The present invention was invented to the problems of the conventional methods of forming a through-hole or through-holes in a circular wall of a cylindrical part of a work piece.

An object of the present invention is to provide a method of forming a through-hole or through-holes, which is capable of preventing formation of burrs, improving machining efficiency and reducing machining cost.

Another object of the present invention is to provide a through-hole forming machine, which is capable of performing the method of the present invention.

To achieve the objects, the present invention has following structures.

Namely, the method of forming a through-hole in a circular wall of a cylindrical part of a work piece comprises the steps of:

setting the work piece to a die;

inserting a punch, which is provided to a rod-shaped metal core, into the cylindrical part; and pressing and moving a press pin toward the die together with the punch so as to drive the punch into an inner face of the circular wall and bore the through-hole, wherein the press pin is inserted in the cylindrical part via a guide through-hole, which has been formed in the circular wall of the work piece and which is located on the opposite side of a prescribed position corresponding to the through-hole to be bored, and contacts a surface of the metal core, which is located on the opposite side of the punch.

Another method is a method of oppositely forming through-holes in a circular wall of a cylindrical part of a work piece comprising the steps of:

boring a guide through-hole, whose diameter is smaller than that of a first through-hole to be bored, at a first prescribed position, at which the first through-hole will be bored, from an outer face of the cylindrical part;

setting the work piece to a die;

inserting a punch, which is provided to a rod-shaped metal core, into the cylindrical part until reaching the first prescribed position;

pressing and moving a press pin toward the die together with the punch so as to drive the punch into an inner face of the circular wall and bore the first through-hole, wherein the press pin is inserted in the cylindrical part via the guide through-hole, which is located on the opposite side of the first prescribed position, and contacts a surface of the metal core, which is located on the opposite side of the punch;

resetting the work piece in the die;

inserting the punch, which is provided to the rod-shaped metal core, into the cylindrical part until reaching a second prescribed position, which is located on the opposite side of the first prescribed position and at which a second through-hole will be bored;

pressing and moving the press pin toward the die together with the punch so as to drive the punch into the inner face of the circular wall and bore the second through-hole including the guide through-hole, wherein the press pin is inserted in the cylindrical part via the first through-hole and contacts the surface of the metal core, which is located on the opposite side of the punch.

The through-hole forming machine for forming a through-hole in a circular wall of a cylindrical part of a work piece comprises:

a die for holding the work piece, the die contacting an outer face of the circular wall of the cylindrical part at a prescribed position corresponding to the through-hole to be bored;

a punch for boring the through-hole with the die, the punch being provided to a front end of a rod-shaped metal core and being inserted into the cylindrical part;

a press pin being inserted in the cylindrical part via a guide through-hole, which is formed in the circular wall of the work piece and which is located on the opposite side of the prescribed position, the press pin contacting a surface of the metal core, which is located on the opposite side of the punch; and a mechanism for relatively pressing and moving the press pin and the punch toward the die so as to drive the punch into an inner face of the circular wall and bore the through-hole.

In the machine, a rear end of the metal core may be detachably attached to a metal core holder.

In the machine, a front end face of the punch may be chamfered along the inner face of the cylindrical part.

The machine may further comprise a mechanism for sucking a scrap, which is formed by boring the through-hole, via a discharge hole of the die.

Another through-hole forming machine for oppositely forming through-holes in a circular wall of a cylindrical part of a work piece comprises:

a first boring unit including a punch for boring a guide through-hole, whose diameter is smaller than that of a first through-hole to be bored, at a first prescribed position, at which the first through-hole will be bored, from an outer face of the cylindrical part; and a second boring unit including:

a die for holding the work piece, the die contacting an outer face of the circular wall of the cylindrical part at prescribed positions corresponding to the first and second through-holes to be bored;

a punch for boring the through-holes with the die, the punch being provided to a front end of a rod-shaped metal core and being inserted into the cylindrical part;

a press pin being inserted in the cylindrical part via the guide through-hole and the first through-hole, the press pin contacting a surface of the metal core, which is located on the opposite side of the punch; and a mechanism for relatively pressing and moving the press pin and the punch toward the die so as to drive the punch into an inner face of the circular wall and bore the through-holes.

Further a work piece of the present invention has a cylindrical part and a through-hole or through holes formed in a circular wall of the cylindrical part, and the through-hole or through-holes are formed by the machine of the present invention.

By the method and the machine of the present invention, forming burrs inside of the cylindrical part can be prevented, machining efficiency can be improved and machining cost can be much reduced.

BRIEF DESCRIPTION OF THE DRAWINGS

Embodiments of the present invention will now be described by way of examples and with reference to the accompanying drawings, in which:

FIG. 2(*b*) is a bottom view thereof;

FIG. 14(*b*) is a front view of the work piece, in which the first guide through-holes are bored;

FIG. 15(*b*) is a front view of the work piece, in which the second guide through-holes are bored;

FIG. 16(*b*) is a front view of the work piece, in which the first through-holes are bored;

FIG. 17(*b*) is a front view of the work piece, in which the second through-holes are bored;

FIG. 18(*b*) is a front view of the work piece, in which the third through-holes are bored;

FIG. 19(*b*) is a front view of the work piece, in which the fourth through-holes are bored.

DETAILED DESCRIPTION OF THE EMBODIMENTS

Preferred embodiments of the present invention will now be described in detail with reference to the accompanying drawings.

Figure 1:
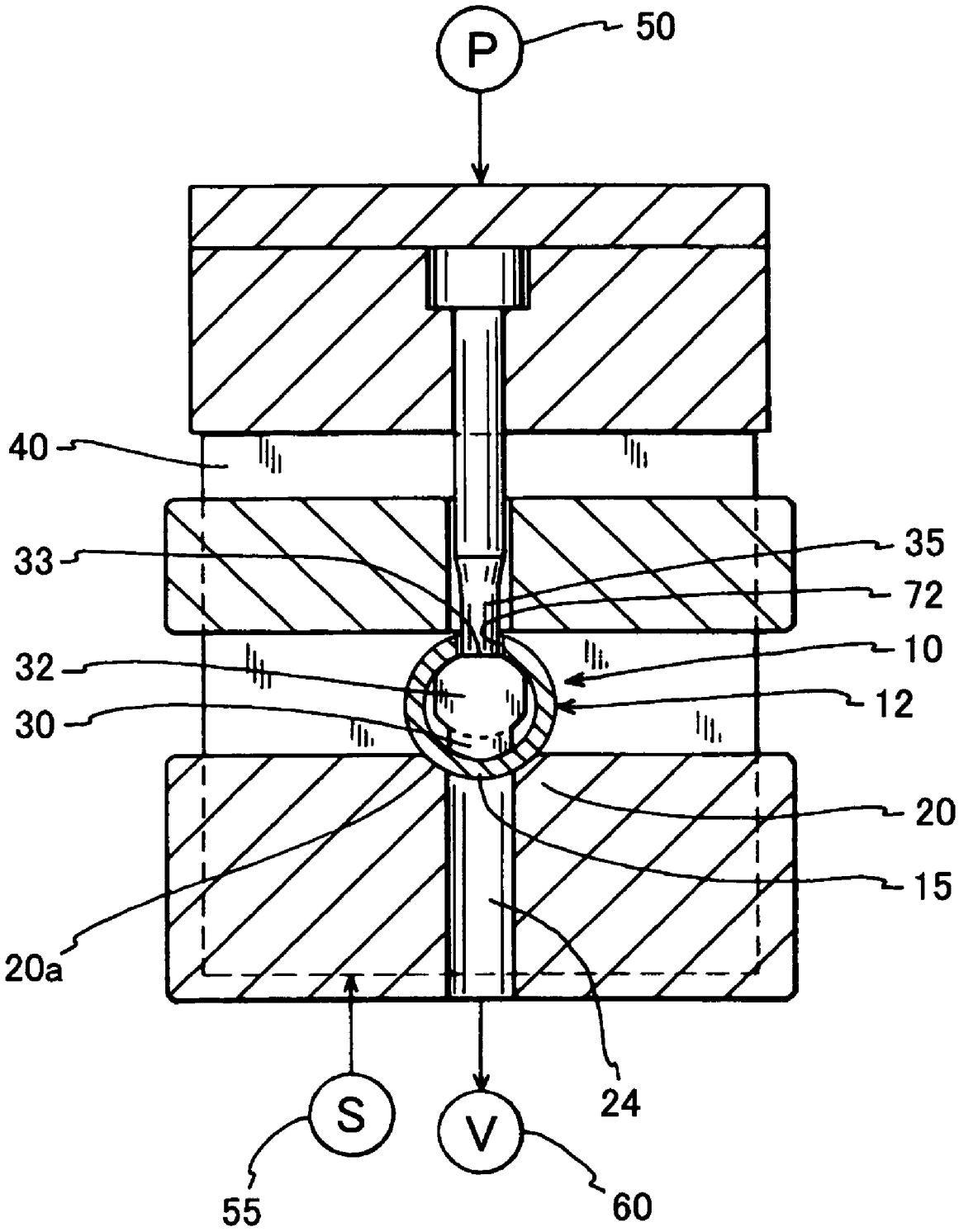
FIG. 1 is a sectional view of an embodiment of the through-hole forming machine of the present invention.
Figure 2A:
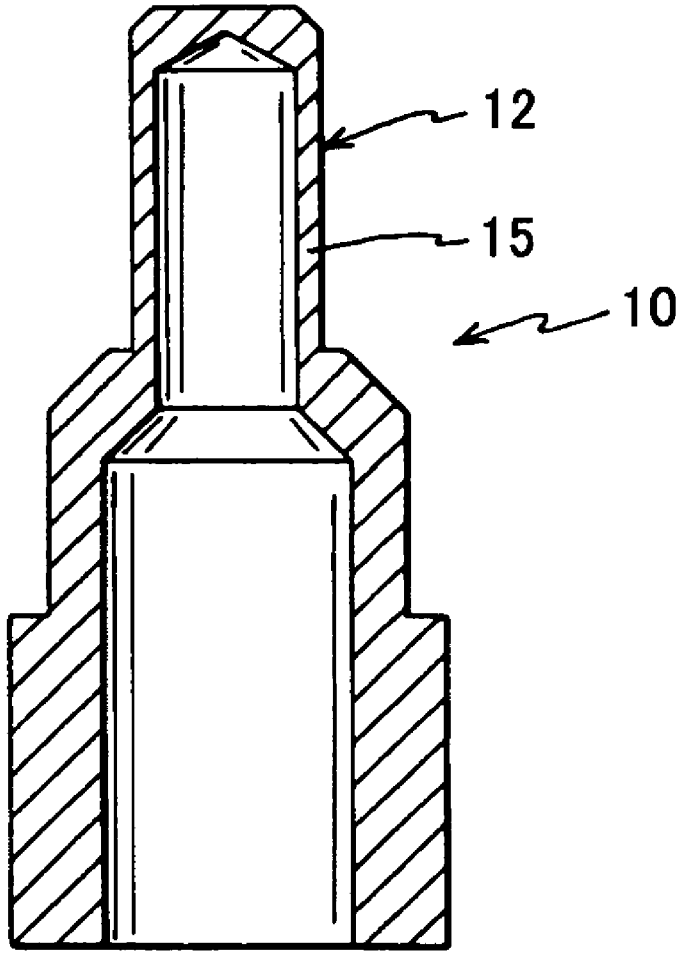
FIG. 2(*a*) is a sectional view of a work piece of the embodiment.
Figure 2B:
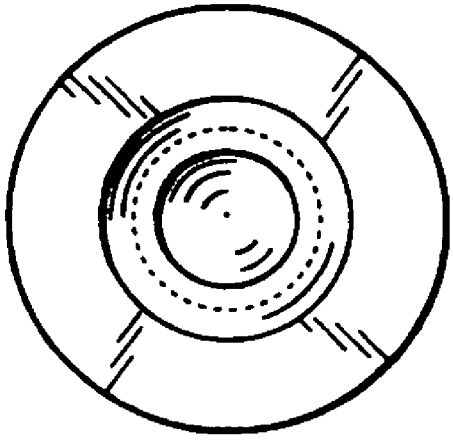

FIG. 1 is a sectional view of an embodiment of the through-hole forming machine of the present invention; FIG. 2(*a*) is a sectional view of a work piece to be machined by the through-hole forming machine; and FIG. 2(*b*) is a bottom view of the work piece.

The through-hole forming machine of the present embodiment bores through-holes in a circular wall of a cylindrical part of a work piece by press means.

A work piece 100 has at least one cylindrical part 12. As shown in FIGS. 2(*a*) and 2(*b*), a diameter of the lower part of the work piece 10 is larger than that of an upper part thereof, and the lower end is opened. For example, the work piece 10 is a small part of an air bag and made by cutting a metallic material. An inner diameter of the cylindrical part 12 is about 9 mm, and a thickness of a circumferential wall thereof is about 1.5 mm. In the present embodiment, the through-hole forming machine bores eight elliptical through-holes 70, each of which has a major axis of about 6 mm and a minor axis of about 5 mm, in the work piece 10. Note that, eight of the through-holes 70 are divided into two groups, and four of the through-holes 70 in each group are arranged in the circumferential direction with the same angular separations of 90 degrees (see FIGS. 18(*a*)-19(*b*)).

A die 20 is used for machining the work piece 10. The die 20 contacts and receives a prescribed position of an outer face of the work piece 10, at which the through-hole 70 will be bored. Therefore, a center part 20*a* of an upper face of the die 20 is formed into a concave shape (see FIG. 1). An inner edge of the center part 20*a*, which acts as a cutting edge, is formed into an obtuse edge, so that damage of the edge can be prevented.

A discharge hole 24 for discharging scraps 80 (see FIG. 6) formed by boring the through-holes 70 is formed in the die 20. A diameter of the discharge hole 24 is gradually made greater toward a lower end of the die block 22 (see FIGS. 4-7), so that the scraps 80 can be suitably discharged without blocking the discharge hole 24.

A punch 30 is provided to a free end (a front end) of a rod-shaped metal core 32, whose base end (rear end) is detachably attached to an elevating block 40, and projected downward. In the present embodiment, a length of the punch 30 projected from the metal core 32 is equal to the thickness of the circumferential wall 15 of the work piece 10. Since the punch 30 is short and the metal core 32 is thick, life spans of the die 20 and the metal core 32 can be made longer. A relief stroke of the punch 30 can be short, so that the metal core 32, which is inserted into the work piece 10, can be made thicker. Therefore, rigidity of the punch 30 and the metal core 32 can be improved, so that their life spans can be made longer. By shortening the punch 30, damages of the punch 30 can be reduced. Machining efficiency can be improved, and machining cost can be highly reduced.

In the present embodiment, the punch 30 and the metal core 32 are integrally formed, but they may be separately made. In case of separately making the punch 30 and the metal core 32, the punch 30 may be fixed to the metal core 32 by proper means, e.g., implanting. In this case too, the punch 30 must be projected from the metal core 32.

Figure 4:
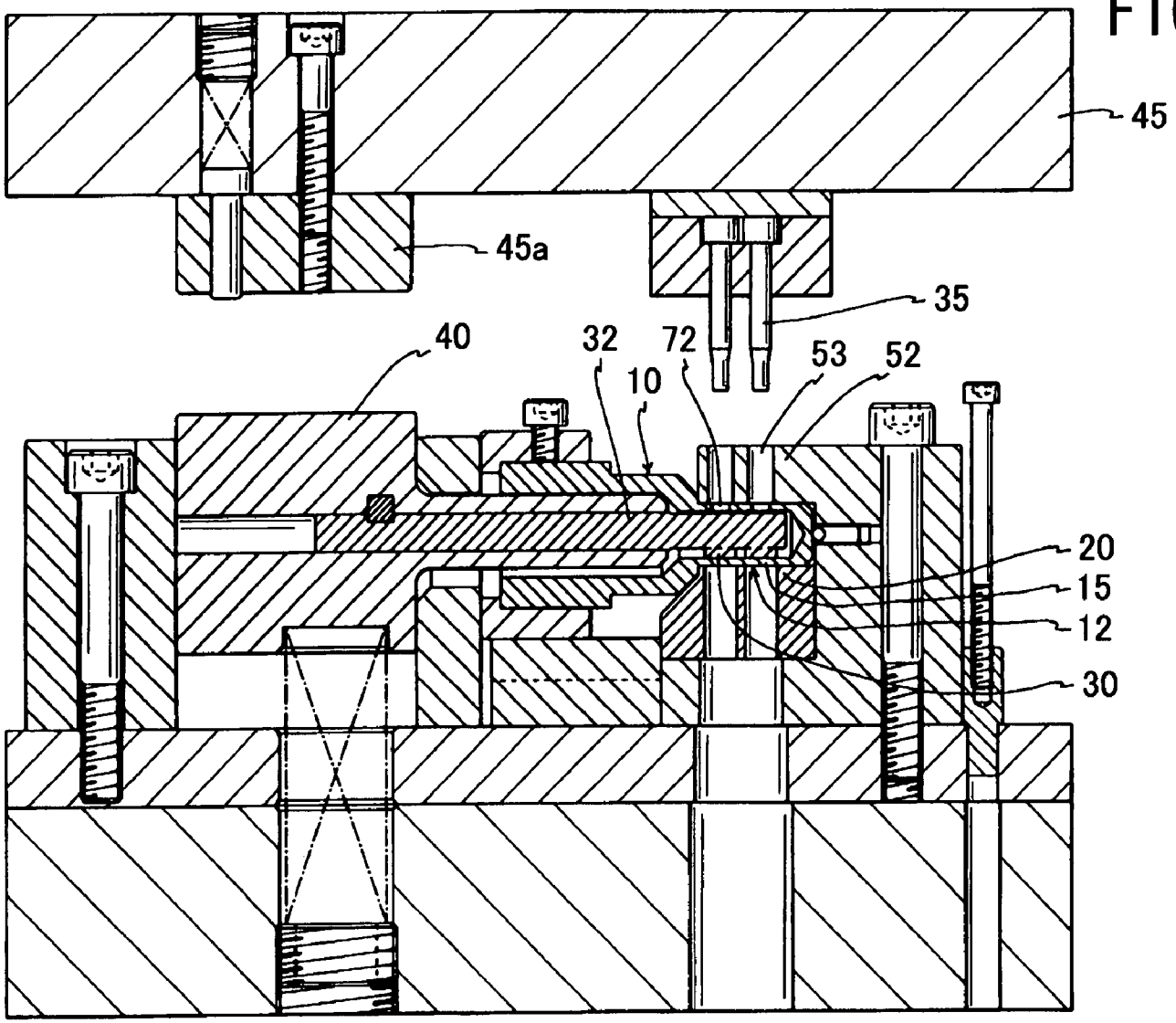
FIG. 4 is a sectional view of a state, in which the work piece is set.

As shown in FIG. 4, the punch 30 is inserted in the cylindrical part 12 while the press-punching process. The lower end of the punch 30 corresponds to the prescribed position of an inner face of the cylindrical part 12, at which the through-hole 70 will be bored. Note that, the work piece 10 may be conveyed, by a proper feeder, so as to cover the front end part 32*a* of the metal core 32 including the punch 30, so that the punch 30 can be relatively inserted in the cylindrical part 12.

As described above, the punch 30 is provided to the front end part 32*a*, and the rear end part 32*b* of the metal core 32 is horizontally fitted in a core hole 42 of an elevating block 40. The metal core 32 is detachably attached to the elevating block 40. Note that, side faces of the metal core 32 are formed into flat faces so as not to turn in the elevating block 42. The metal core 32 can be easily exchanged.

The free end part 32*a* of the metal core 32 is horizontally projected from the elevating block 40, and the metal core 32 is formed into the rod-shape. If no means for pressing the free end part 32*a*, e.g., a press pin 35, is provided, great moment is applied to the metal core 32 by a pressing force when the press-punching is performed. Therefore, the metal core 32 is easily damaged by the pressing force.

The elevating block 40 has an extended section 40*a* (see FIG. 3), which is horizontally extended. The rear end part 32*b* of the metal core 32 is inserted and held in the extended section 40*a* so as to increase strength of the metal core 32. With this structure, the metal core 32 can be formed into a mere rod-shape, and manufacturing cost of the metal core 32 can be reduced. Note that, a shape of the metal core 32 is not limited to the present embodiment. The front end part 32*a* should be inserted into the cylindrical part 12 of the work piece 10, but other parts including the rear end part 32*b* are not limited. The rear end part 32*b* should be properly fixed, but its shape is not limited.

The press pin 35 is inserted in the cylindrical part 12 of the work piece 10 via a guide through-hole 72, which has been formed in the circular wall 15 of the work piece 10 and which is located on the opposite side of the prescribed position corresponding to the through-hole 70 to be bored, and contacts a surface 33 of the metal core 32, which is located on the opposite side of the punch 30.

The press pin 35 is pressed and moved together with the core metal 32 and the punch 30. With the above described structure, the press pin 35 holds the metal core 32 from the upper side, so that the press pin 35 presses the punch 30 to bore the through-hole 70. Namely, the elevating block 40 and the press pin 35 press the metal core 32 downward, so that the punch 30 is driven into the circular wall 15.

Therefore, applying the great moment to the free end part 32*a* of the metal core 32 can be prevented, so that damaging the punch 30 and the metal core 32 can be prevented. Life spans of the punch 30 and the metal core 32 can be made longer, machining efficiency can be improved and manufacturing cost can be reduced.

Pressing means 50 downwardly presses and moves the press pin 35, together with the punch 30 and the metal core 32, toward the die 20 so as to drive the punch 30 into the inner face of the circular wall 15 of the work piece 10 and form a sheared part and a broken part. With this action, the through-hole 70 can be bored.

Figure 5:
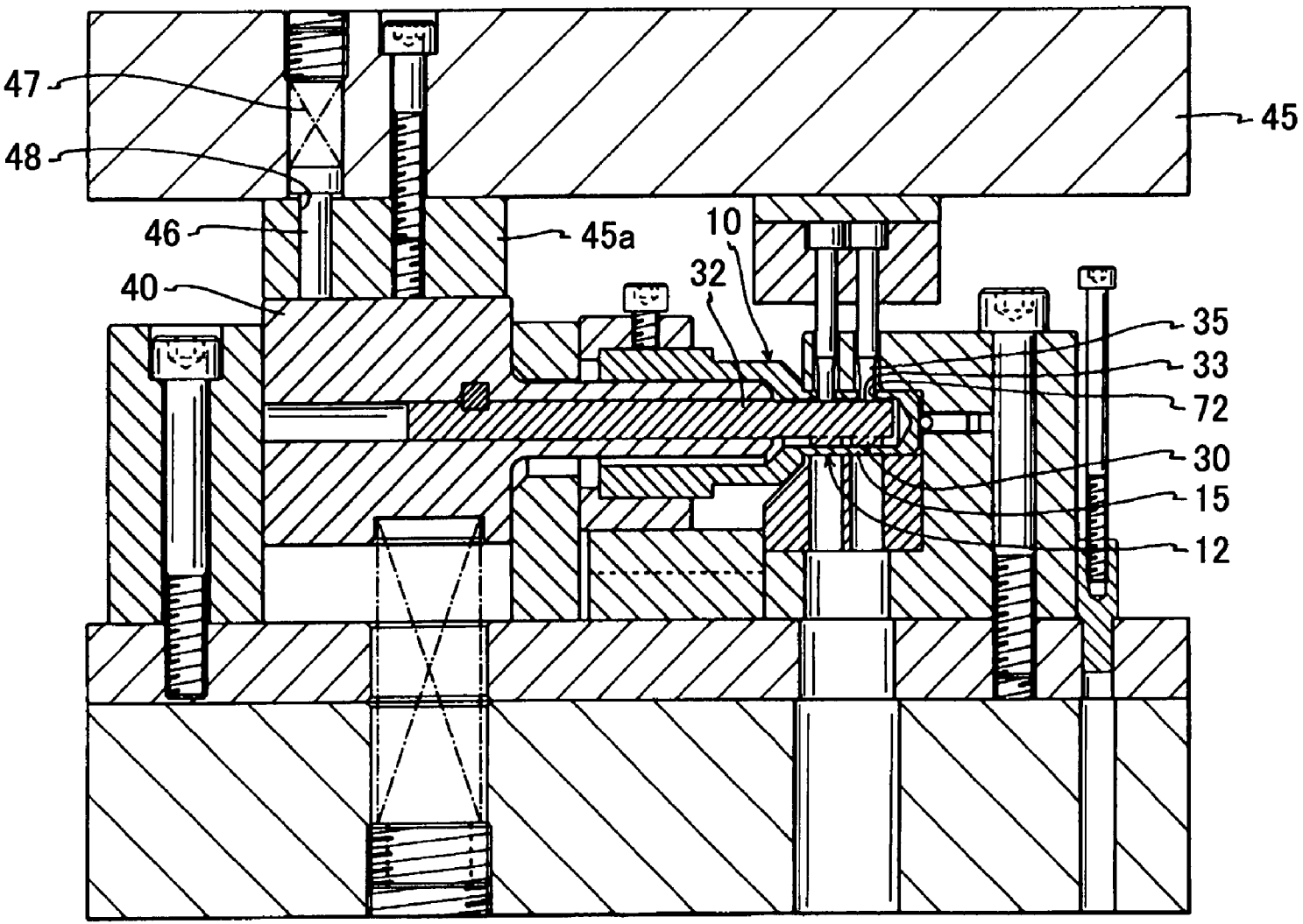
FIG. 5 is a sectional view of a state, in which boring through-holes is started.
Figure 6:
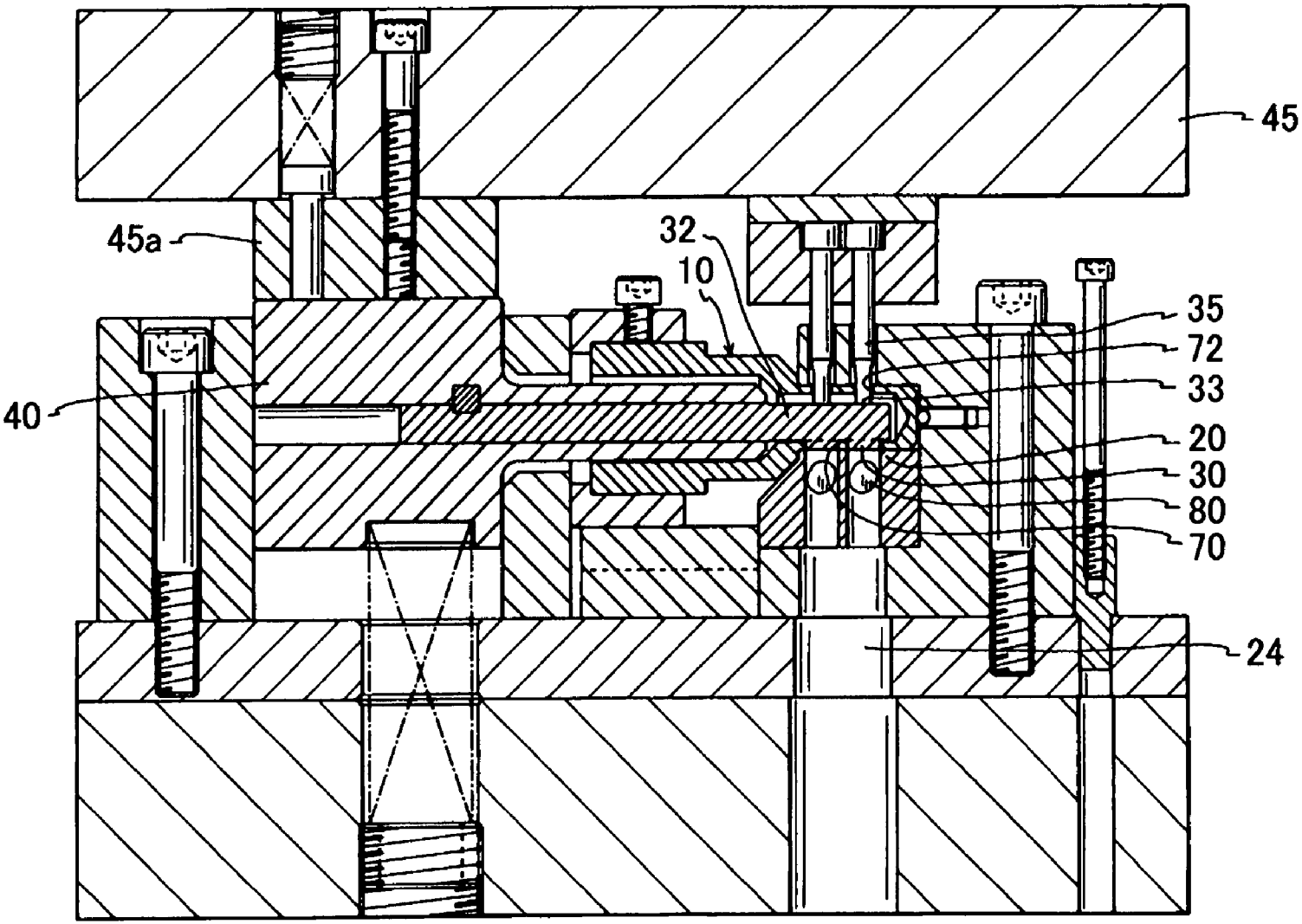
FIG. 6 is a sectional view of a state, in which boring the through-holes is completed.

In the present embodiment, firstly the press pin 35 is moved downward (see FIGS. 4 and 5), then the punch 30 is further moved downward together with the punch 30 and the metal core 32 held by the elevating block 40 (see FIGS. 5 and 6). With this action, the punch 30 is downwardly driven into the circular wall 15 at a right angle.

For example, a cylinder unit may be used as the pressing means 50.

To suitably form the sheared part and the broken part, a prescribed clearance should be formed between the die 20 and the punch 30. For example, in case of boring a circular through-hole in a work piece made of iron, the suitable clearance is determined on the basis of the following formula:

$$\text{(Inner diameter of the die)}=\text{(Outer diameter of the die)}+[\text{Thickness of the work piece}\times(5\text{-}10\%)]\times 2$$

Self returning means 55 makes the elevating block 40, the metal core 32, which includes the punch 30, and the press pin 35 to initial positions when the pressing action is completed. For example, the self returning means 55 includes a coil spring 56 (see FIGS. 3-7) and a coil spring 57 (see FIG. 3). The coil spring 56 is elastically provided between the elevating block 40 and a base board 43 so as to upwardly return the elevating block 40 and the metal core 32 including the punch 30 to the initial positions; the coil spring 57 upwardly returns the press pin 35 to the initial position.

Figure 8:
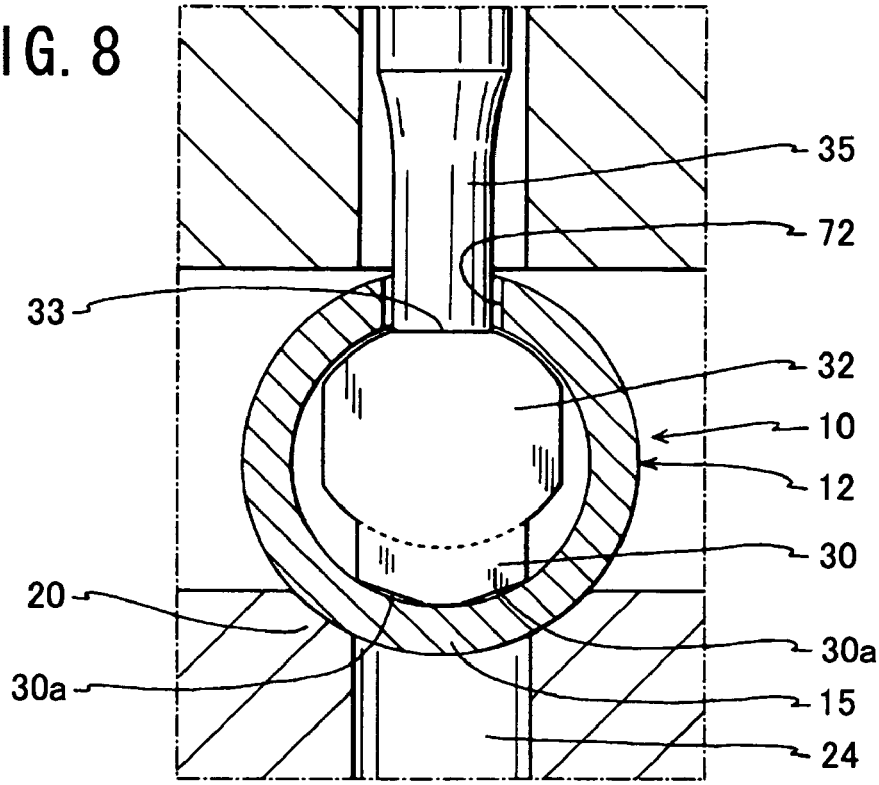
FIG. 8 is a front view of the punch and a die, which start to bore the through-holes.
Figure 9:
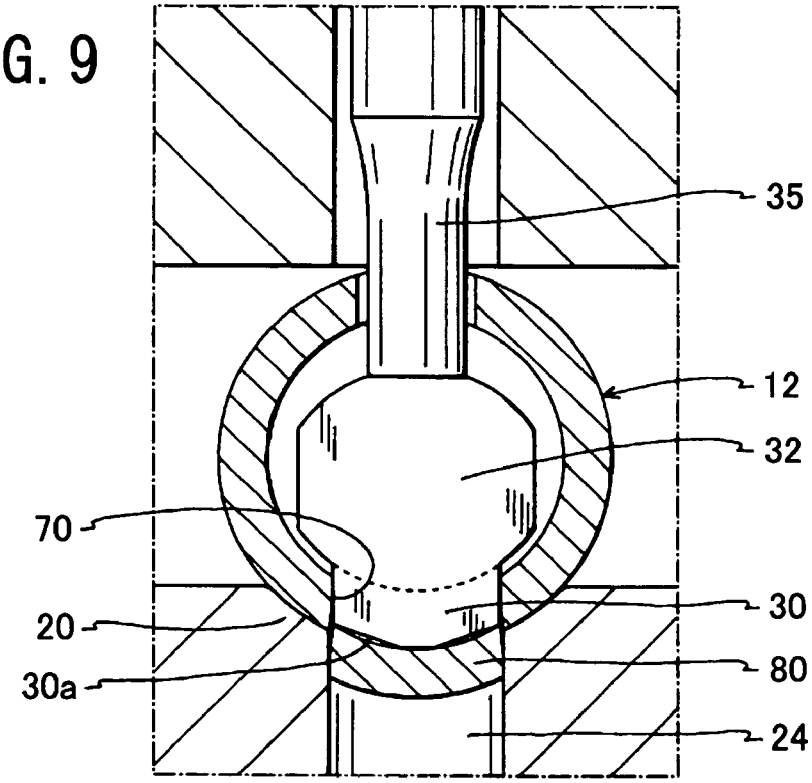
FIG. 9 is a front view of the punch and the die, which completely bore the through-holes.

As shown in FIGS. 8 and 9, a lower end face of the punch 30, which acts as a cutting edge, is chamfered along the inner circumferential face of the cylindrical part 12 of the work piece 10. Note that, FIG. 8 is a front view of the punch 30 and the die 20, which start to bore the through-hole 70, and FIG. 9 is a front view of the punch 30 and the die 20, which completely bore the through-hole 70.

In the present embodiment, two chamfered parts 30*a*, which correspond to the inner circumferential face of the cylindrical part 12, are formed on the right and the left sides of the punch 30.

By forming the chamfered parts 30*a*, the lower end of the punch 30 contacts the inner circumferential face of the cylindrical part 12 at a plurality of points, so that damages of the punch 30 can be prevented. Further, by forming the chamfered parts 30*a*, shearing angles are made as well as scissors, so that the pressing force can be suitably dispersed and the through-hole 70 can be suitably bored.

With this merit, the life span of the parts of the machine can be made longer, and the machining cost can be reduced.

By using the punch 30 having the chamfered parts 30*a*, no scraps stick onto the lower end of the punch 30 so that the machining efficiency can be improved.

Vacuum sucking means 60 (see FIG. 1) sucks and removes the scraps 80 (see FIG. 6) via the discharge hole 24 of the die 20 when the through-holes 70 are bored, so that the through-hole 70 can be securely opened.

When the scrap 80 is formed, the sucking means 60 is sucking air so that the scrap 80 is sucked immediately after the scrap 80 is separated from the work piece 10. Therefore, the through-hole 70 can be securely opened without leaving the scrap 80.

Figure 10:
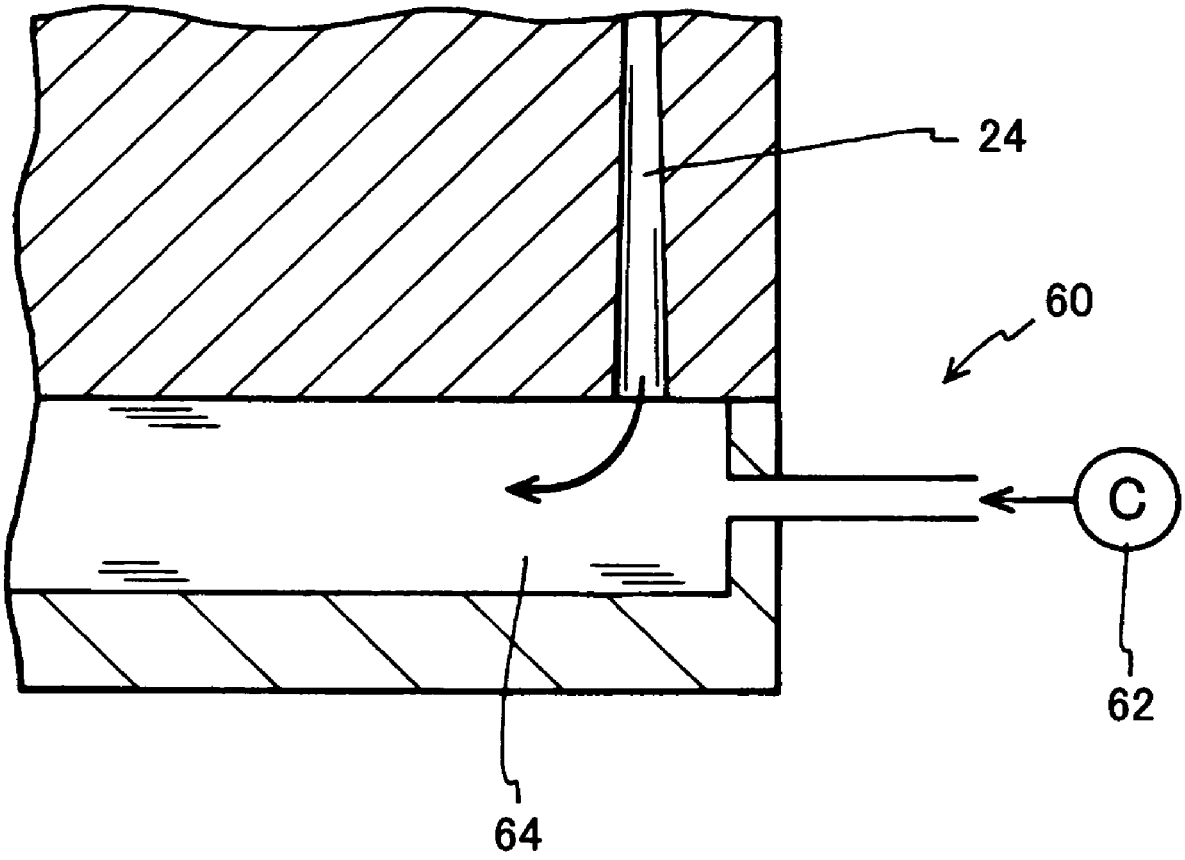
FIG. 10 is a sectional view of an example of a vacuum sucking unit.

For example, a vacuum sucking unit shown in FIG. 10 may be used as the vacuum sucking means 60. In the vacuum sucking unit, compressed air is introduced into a wide path 64, whose sectional area is broader than that of the discharge hole 24, from a compressed air source 62 so that a negative pressure is generated in the discharge hole 24 by the venturi effect. By generating the negative pressure, the scraps 80 are sucked and removed via the discharge hole 24 and the wide path 64. By always forming the negative pressure, the scraps 80 can be immediately removed.

By using the above described sucking means, an ordinary compressor may be used as the compressed air source 62. Namely, the sucking means can be easily made. Note that, other sucking means, e.g., vacuum unit, pressure reduction unit, may be employed.

By examining the sheared part and the broken part, existence of the through-hole 70 in the circumferential wall 15 of the cylindrical part 12 of the work piece 10 can be known.

Next, the process of boring the through-holes 70 in the circumferential wall 15 of the cylindrical part 12 of the work piece 10, which is performed in the above described through-hole forming machine, will be explained with reference to FIGS. 3-9.

Figure 3:
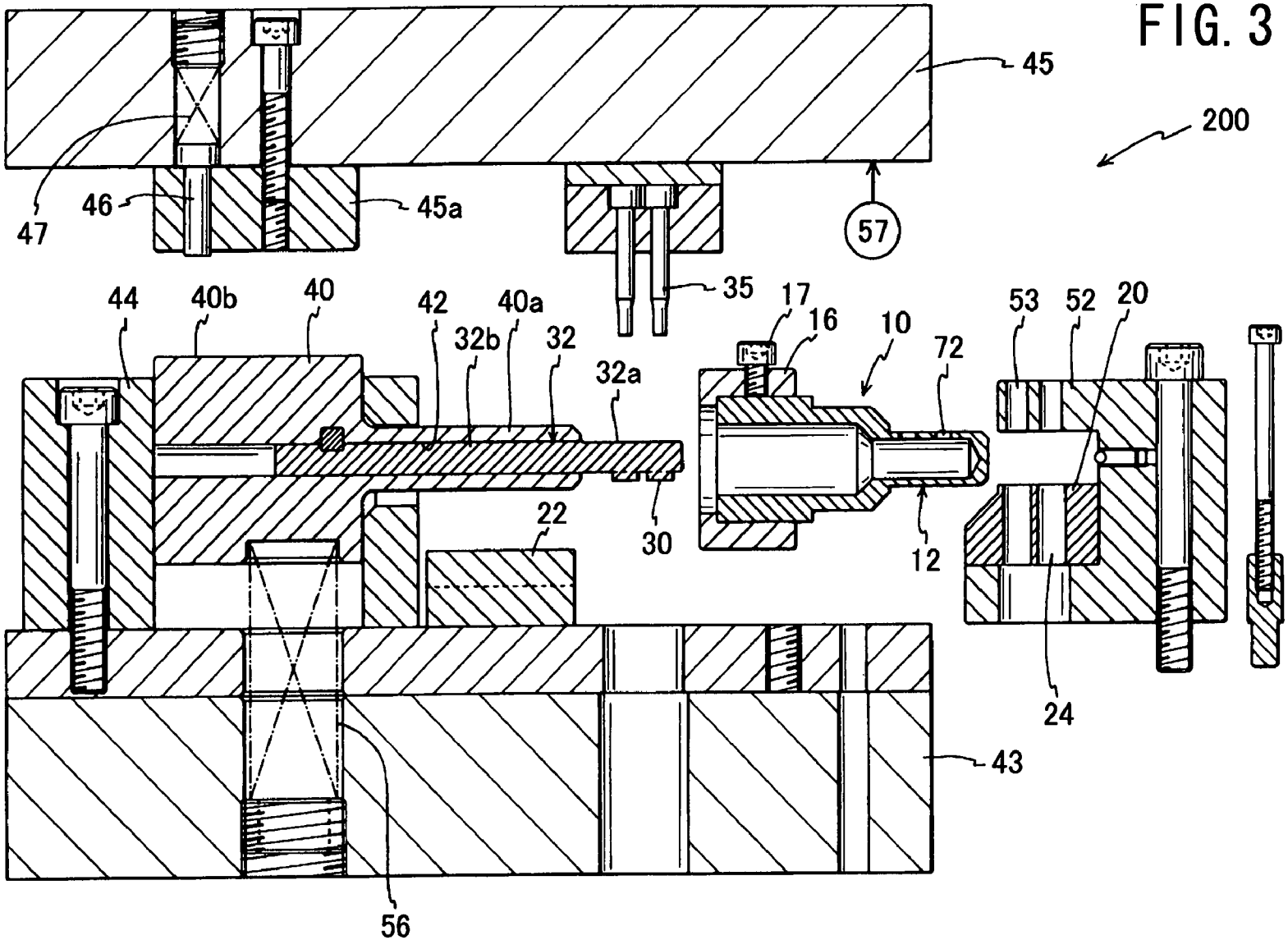
FIG. 3 is a sectional view of a second boring unit.

Firstly, as shown in FIG. 3, the work piece 10 is mounted and set in the die 20.

The work piece 10 is fitted in a jig 16, which has a rectangular external shape so as not to rotate, and fixed by a screw 17. The jig 16 is received at a prescribed position by a receiving section 22, so that the work piece 10 can be correctly positioned. A guide 44 guides the vertical movement of the elevating block 40.

A press plate 45 is pressed by the pressing means 50 (see FIG. 1). Two of the press pins 35 are attached to the press plate 45. A block pin 46, which presses the elevating block 40, is provided to a pressing section 45*a* of the press plate 45. The block pin 46 is always biased downward by a spring 47, so that the block pin 46 downwardly pushes the elevating block 40 when the punch 30 is pulled out from the work piece 10.

A stripper section 52 presses the work piece 10 when the punch 30 is pulled out from the work piece 10. The stripper section 52 has two guide holes 53 through which the press pins 35 respectively pass.

FIG. 4 is a sectional view, in which the work piece 10 is set in the die 20.

The die 20 contacts the prescribed positions of the outer face of the circular wall 15, at which the through-holes 70 will be bored. Two of the punches 30, which are provided to the front end part 32*a* of the metal core 32, are inserted into the cylindrical part 12 of the work piece 10 until they respectively reach the prescribed positions.

In this state, the press plate 45 is located at the uppermost position, and the press pins 35 are located above the stripper section 52. Further, the pressing section 45*a* is located above the elevating block 40.

Next, as shown in FIG. 5, the press plate 45 is moved downward, and the pressing section 45*a* contacts an upper face of the elevating block 40. Simultaneously, the press pins 35 are inserted into the work piece 20 via guide through-holes 72 (see FIG. 4) until contacting the upper surface 33 of the metal core 32.

As shown in FIG. 8, two of the chamfered parts 30*a* are formed at the lower end of each punch 30. Four corners formed by the chamfered parts 30*a* firstly contact the inner face of the circumferential wall 15. With this action, the shearing angles are made as described above, so that the through-holes 70 can be suitably bored.

The block pin 46 is moved upward, against the elasticity of the coil spring 47, and accommodated in an accommodating hole 48.

Then, as shown in FIG. 6, the press plate 45 is further moved downward to press the elevating block 40, so that the punches 30 are relatively pressed and moved toward the die 20 and driven into the inner face of the circumferential wall 15. Simultaneously, the press pins 35, which have been respectively inserted in the guide through-holes 72 located on the opposite side with respect to the prescribed position and which have contacted the surface 33 of the metal core 32 located on the opposite side of the punches 30, are pressed and moved so as to move together with the metal core 32 and the punches 30. With this action, the punches 30 are driven into the inner face of the circumferential wall 15, so that the through-holes 70 can be bored.

The punches 30 are driven into the circumferential wall 15 as shown in FIG. 9. At that time, the lower ends of the punches 30, each of which has the chamfered parts 30*a*, make the suitable shearing angles as described above, so that the through-holes 70 can be suitably bored.

When the through-holes 70 are completely bored, the scraps 80 are can be sucked by the vacuum sucking means 60 via the discharge hole 24 of the die 20, so that the scraps 80 can be securely removed from the through-holes 70. By securely removing the scraps 80, manufacturing efficiency can be improved.

Figure 7:
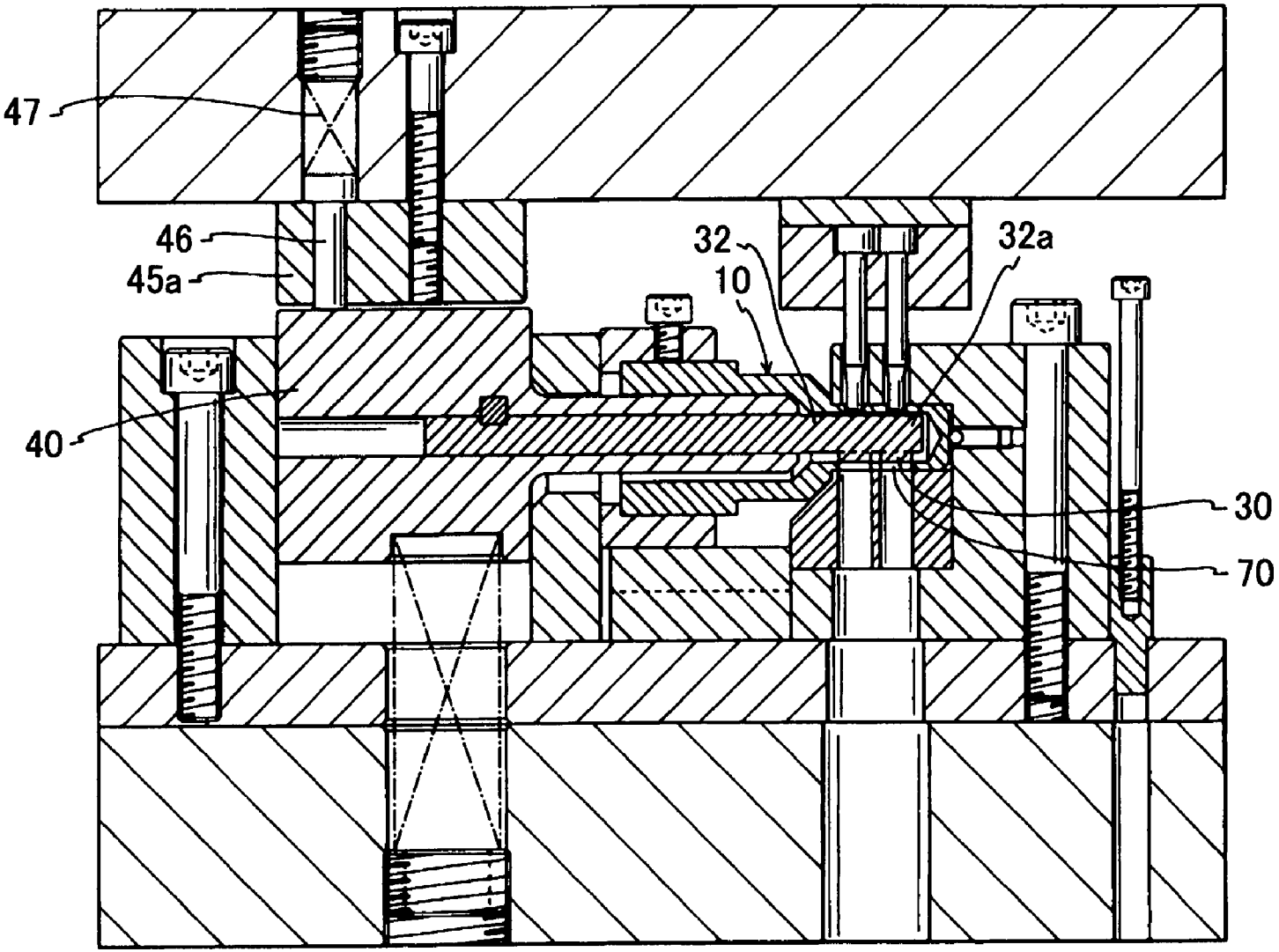
FIG. 7 is a sectional view of a state, in which punches are pulled out from the work piece.

When the punches 30 are pulled out from the work piece 10, the block pin 46 is projected downward by the elasticity of the coil spring 47 so as to press the elevating block 40 (see FIG. 7). With this action, the front end part 32*a* of the metal core 32, in which two of the punches 30 are provided, is bent upward, so that the punches 30 can be easily pulled out from the work piece 10.

This action will be explained in detail. The block pin 46 presses a rear part 40*b* (see FIG. 3) of the elevating block 40, which is located on the opposite side of the extended section 40*a* with respect to the coil spring 56, from the upper side. A small clearance is formed between the elevating block 40 and the guide 44 so as to allow the elevating block 40 to move in the vertical direction. By forming the small clearance, the front end part 32*a* of the metal core 32 is apt to move downward when the punches 30 are pulled out from the work piece 10. If the metal core 32 is long, a displacement distance of the front end part 32*a* must be long. Thus, the front end part 32*a* can be returned to the horizontal initial position by pressing the rear part 40*b* of the elevating block 40 with the block pin 46. The pressing force of the block pin 46 lifts the front end part 32*a* of the metal core 32 upward. At that time, the coil spring 56 works as a fulcrum point. With this action, the punches 30 can be smoothly pulled out from the thorough-holes 70 of the work piece 10.

As described above, the through-holes 70 are bored by driving the punches into the inner face of the cylindrical part 12, so that no burrs are formed in the inner face thereof. Therefore, a burring step can be omitted. Since the punches 30 are pressed by the press pins 35, a great pressing force can be applied so that large through-holes can be easily bored. Further, the metal core 32 is held by the elevating block 40 and the press pins 35, so the bend or deformation of the metal core 32 can be prevented. Therefore, damages of the punches 30 and the metal core 32 can be prevented, and their life spans can be made longer.

Namely, manufacturing efficiency can be improved, and machining cost can be reduced.

Next, another embodiment of the present invention will be explained with reference to FIG. 11-19.

The through-hole forming machine of the present embodiment comprises a first boring unit 100 for boring guide through-holes 72 and a second boring unit 200 (see FIG. 3) for boring the through-holes 70. The first boring unit 100 includes punches 37 for boring the guide through-holes 72, whose diameters are smaller than those of the through-holes 70 to be bored, at prescribed positions, at which the through-holes 70 will be bored, from an outer face of the cylindrical part 12 of the work piece 10. In the present embodiment, the through-hole forming machine shown in FIGS. 3-7 is employed as the second boring unit 200.

Figure 11:
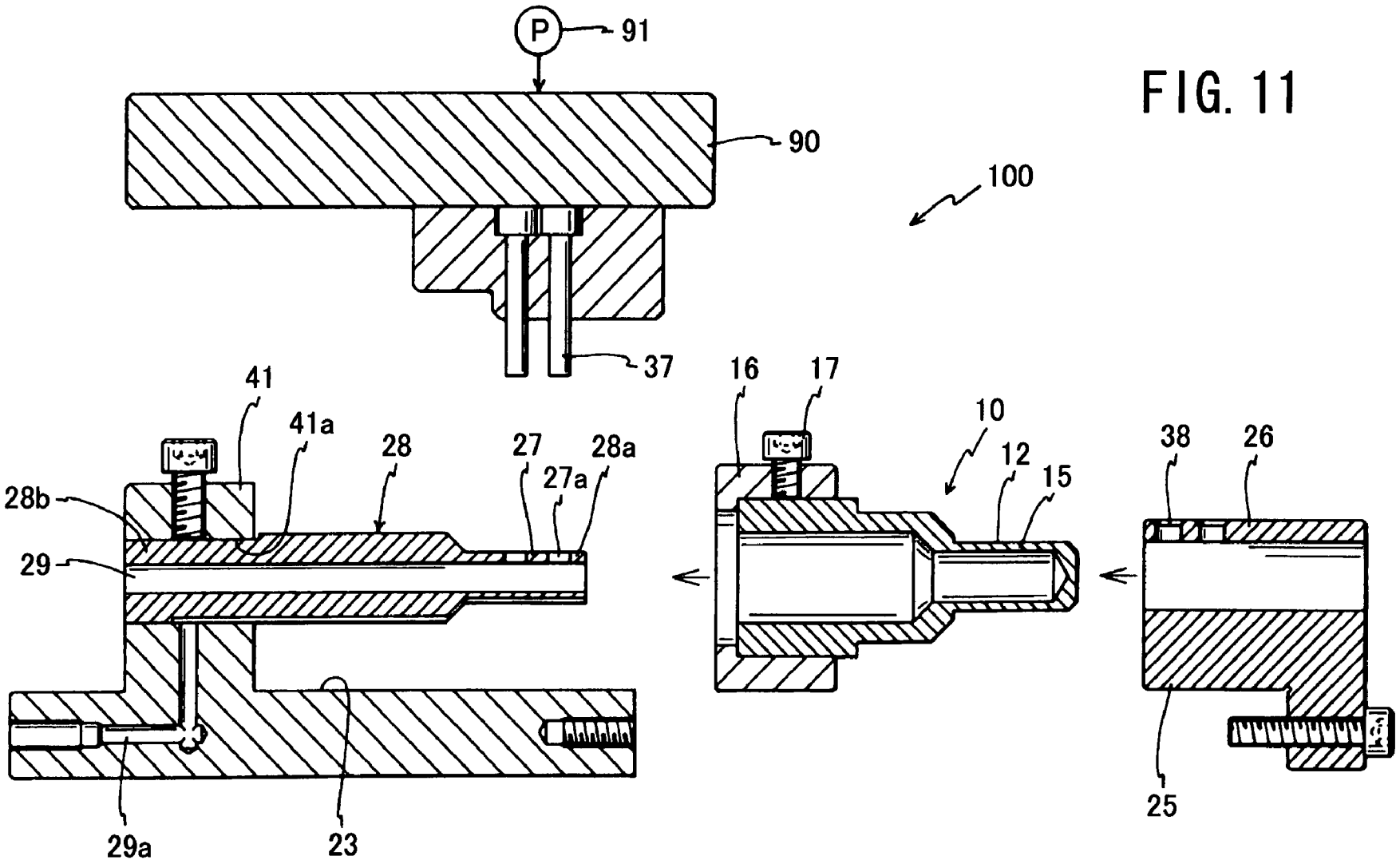
FIG. 11 is a sectional view of a first boring unit.

In FIG. 11, a die 27 is formed at a free front end 28*a* of a rod-shaped die core 28. The die 27 is formed in an upper part of a side wall of the die core 28. The die 27 is inserted into the cylindrical part 12 of the work piece 10 until reaching a prescribed position so as to bore the guide through-holes 72 (see FIGS. 12 and 13). Note that, the work piece 10 may be conveyed by a feeder unit so as to relatively insert the die 27 into the cylindrical part 12 of the work piece 10.

A rear end part 28*b* of the die core 28 is horizontally inserted in a hole 41*a* of a holder 41 and detachably attached therein by a screw. Note that, the die core 28 has flat side faces so as not to rotate. Therefore, the die core 28 can be easily exchanged.

A discharge through-hole 29 for discharging scraps is formed in the die core 28 and extended in the axial direction. The discharge through-hole 29 is communicated to die holes 27*a* of the die 27. An air path 29*a*, which is communicated to a compressed air source (not shown), is communicated to the discharge through-hole 29 so as to introduce compressed air to the discharge through-hole 29 from the front end 28*a* side. With this structure, scraps 82 (see FIG. 13) can be blown away from the front end 28*a* to the rear end 28*b*, so that the scraps 82 can be securely and efficiently removed. Therefore, manufacturing efficiency can be improved.

The work piece 10 is fitted in the jig 16, which has a rectangular external shape so as not to rotate, and fixed by the screw 17. A holding section 23 holds the jig 16 at a predetermined position, so that the work piece 10 can be correctly positioned. Another holder 25 holds and positions the cylindrical part 12 of the work piece 10.

A press plate 90 is pressed downward by pressing means 91. Two pin-shaped punches 37, each of which has a circular sectional shape, are attached to the press plate 90.

A stripper section 26 presses the work piece 10 when the punches 37 are pulled out from the work piece 10. In the present embodiment, the stripper section 26 is integrally formed with the holder 25. The stripper section 26 has two guide holes 38, through which the punches 37 pass.

Next, a method of forming the guide through-holes 72 by the first boring unit 100 will be explained with reference to FIGS. 11-13.

FIG. 11 shows a sectional view of an opened state of the first boring unit 100, in which the work piece 10 is not set to the die 27. In this state, the press plate 90 is located at the uppermost position, and the punches 37 are located above the die 27. Note that, the pressing means 91 and means for returning the press plate 90 are the same as those shown in FIGS. 1 and 3-7, so explanation will be omitted.

Figure 12:
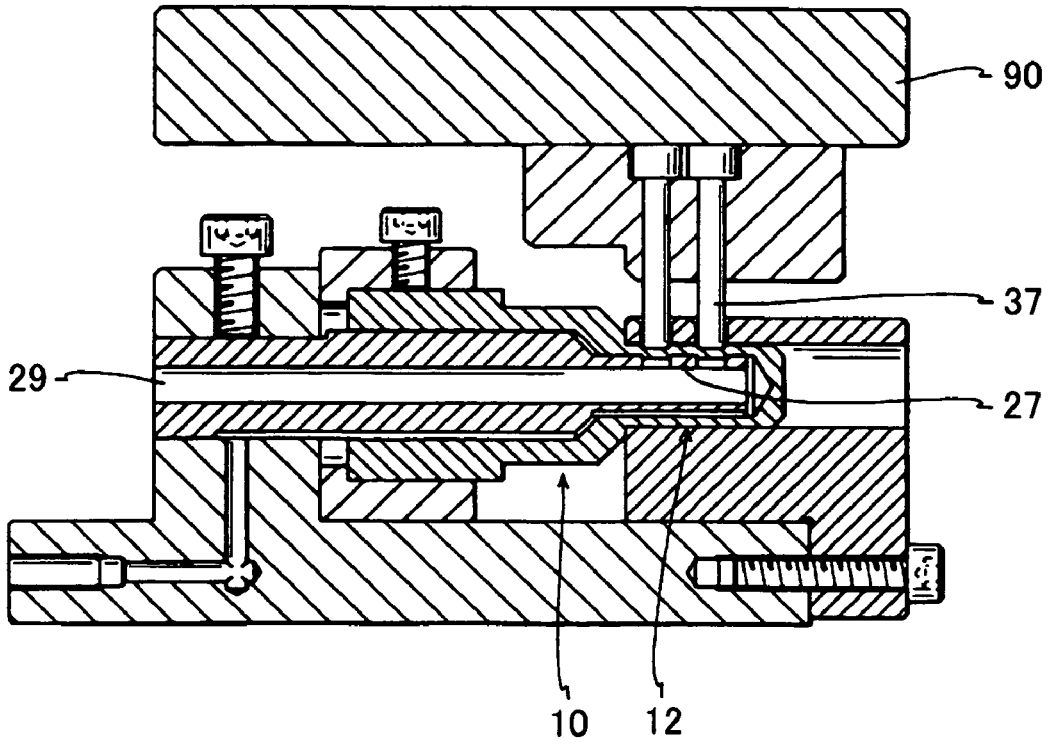
FIG. 12 is a sectional view of the first boring unit, in which guide through-holes are bored partway.

FIG. 12 is a sectional view of the unit 100, in which the work piece 10 is set to the die 27 and the punches 37 are moved downward to bore the guide through-holes 72.

Diameters of the guide through-holes 72 may be relatively small with respect to an inner diameter of the work piece 10. Further the diameters of the guide through-holes 72 are smaller than those of the through-holes 70 to be bored.

Therefore, a sectional shape of edges of the die holes 27*a* of the die 27, which act as cutting edges, are not acute edges, so that a life span of the die 27 can be made longer and manufacturing efficiency can be improved.

Figure 13:
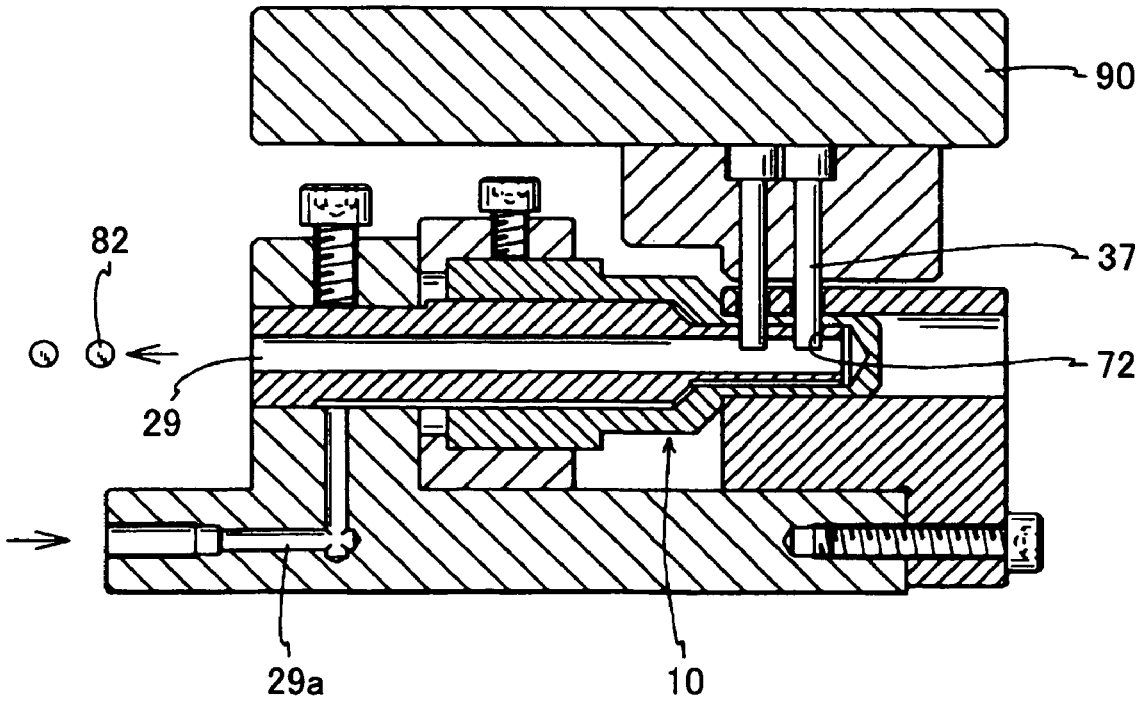
FIG. 13 is a sectional view of the first boring unit, in which the guide through-holes are completely bored.

FIG. 13 is a sectional view of the unit 100, in which the punches 37 are further moved downward to completely bore the guide through-holes 72 in the circumferential wall 15.

The scraps 82 are blown away and removed via the discharge through-hole 29. Since the guide through-holes 72 are smaller than the through-holes 70, sizes of the scraps 82 are small so that they can be removed without blocking the discharge through-hole 29. Therefore, the guide through-holes 72 can be efficiently formed.

Note that, the guide through-holes 72 will be disappeared when the through-holes 70 are bored at the positions of the guide through-holes 72.

Since the guide through-holes 72 will be disappeared, the guide through-holes 72 may be roughly formed in some cases. In those cases, guide through-holes 72 may be formed by known proper methods.

Next, a method of forming eight through-holes in the work piece 10, by the first and second boring units 100 and 200, will be explained with further reference to FIGS. 14(*a*)-19(*b*). The method includes six steps. Note that, as described above, eight of the through-holes are divided into two groups, and four of the through-holes in each group are arranged in the circumferential direction with the same angular separations of 90 degrees (see FIGS. 18(*a*)-19(*b*)). The method includes six steps.

Figure 14A:
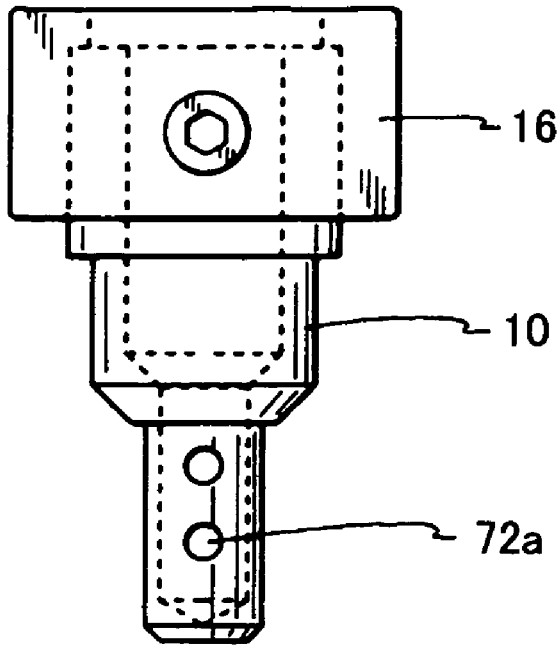
FIG. 14(*a*) is a plan view of a work piece, in which first guide through-holes are bored.
Figure 14B:
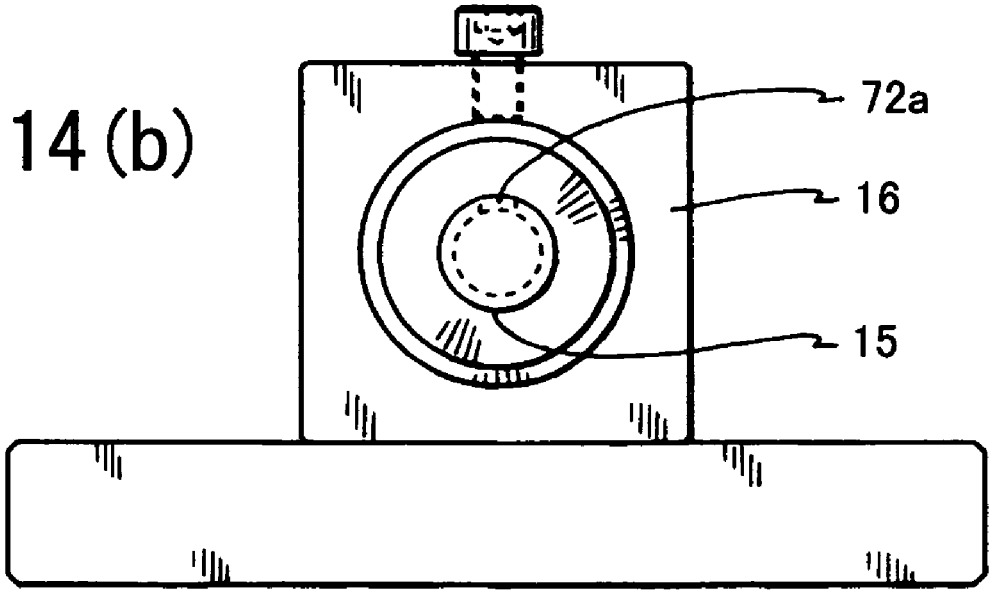

A first step is shown in FIGS. 14(*a*) and 14(*b*). The first boring unit 100 drives the punches 37 into the outer face of the work piece 10 and bores two first guide through-holes 72*a*.

Figure 15A:
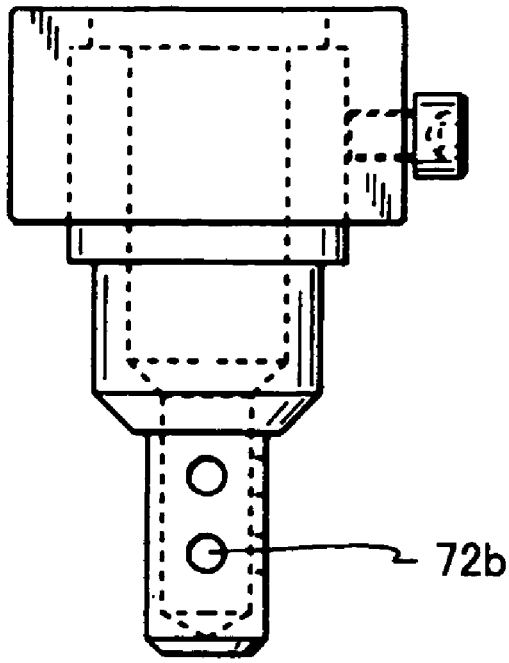
FIG. 15(*a*) is a plan view of the work piece, in which second guide through-holes are bored.
Figure 15B:
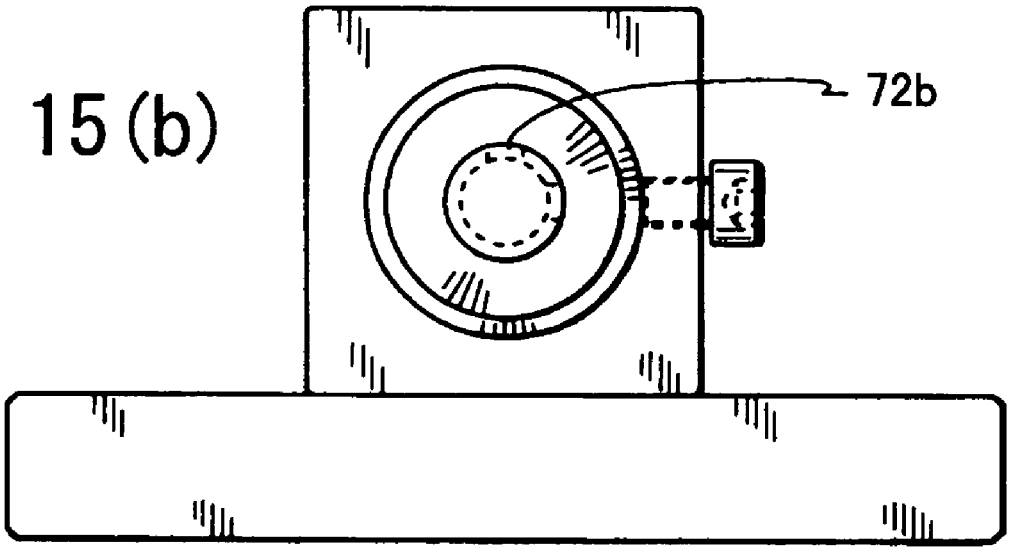

A second step is shown in FIGS. 15(*a*) and 15(*b*). The first boring unit 100 bores two second guide through-holes 72*b*, which are separated 90 degrees, in the circumferential direction, from the first guide through-holes 72*a*. At that time, the jig 16 is turned 90 degrees in the clockwise direction, then the second guide through-holes 72*b* are bored.

Figure 16A:
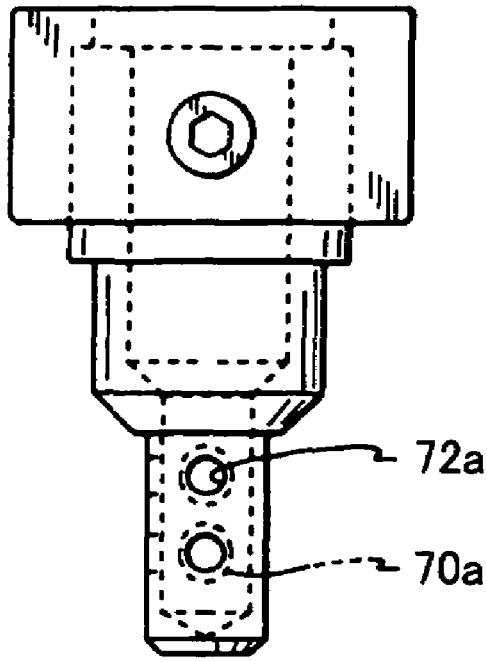
FIG. 16(*a*) is a plan view of the work piece, in which first through-holes are bored.
Figure 16B:
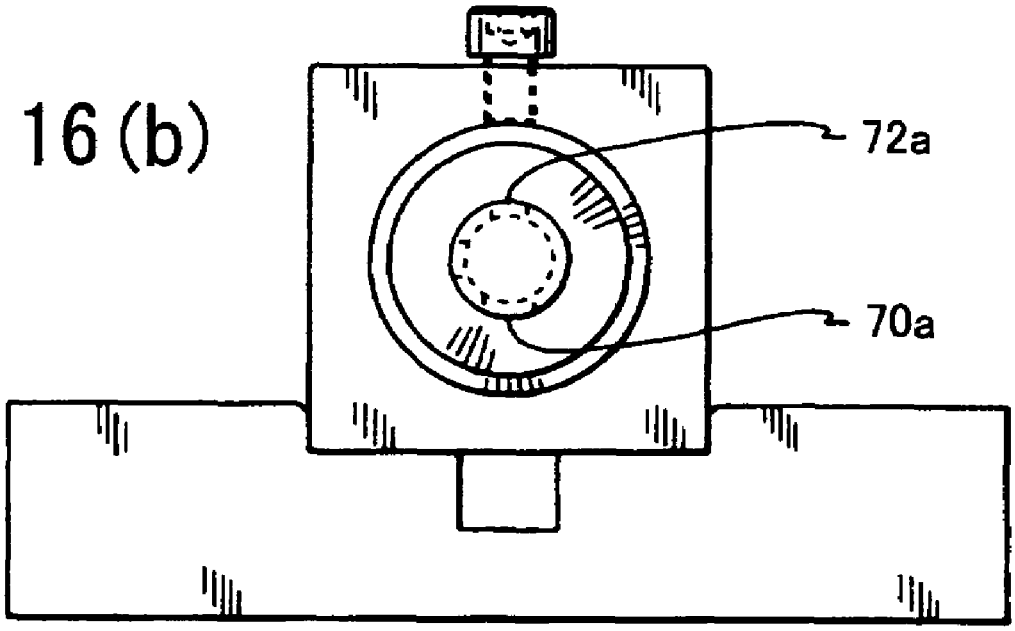

A third step is shown in FIGS. 16(*a*) and 16(*b*). The jig 16 is turned 90 degrees in the counterclockwise direction and fixed, then the second boring unit 200 drives the punches 30 into the prescribed positions of the inner face of the circumferential wall 15, which are located on the opposite side of the first guide through-holes 72*a*, so as to bore two first through-holes 70*a*.

Figure 17A:
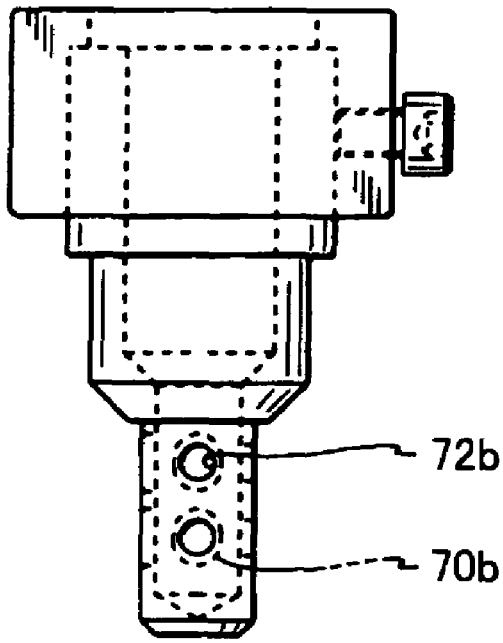
FIG. 17(*a*) is a plan view of the work piece, in which second through-holes are bored.
Figure 17B:
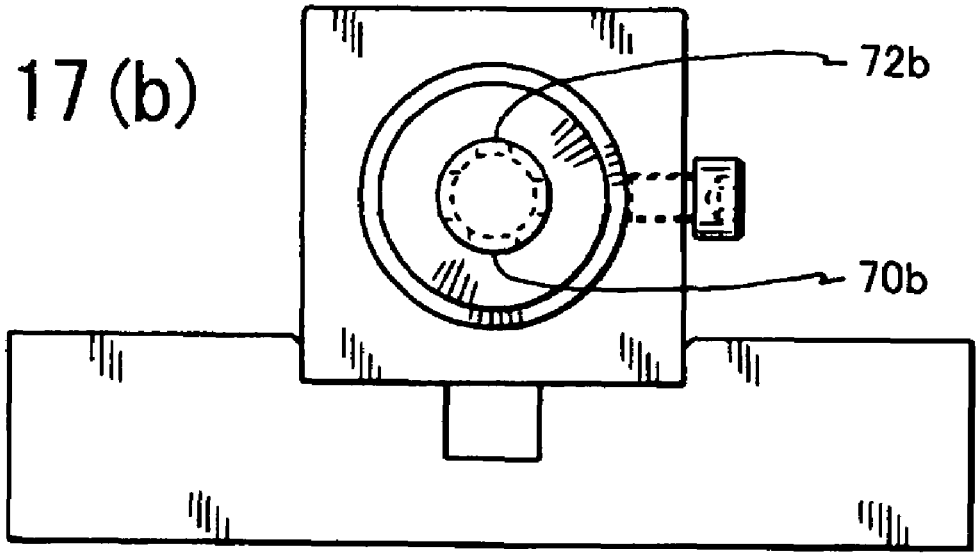

A fourth step is shown in FIGS. 17(*a*) and 17(*b*). The jig 16 is turned 90 degrees in the clockwise direction and fixed, then the second boring unit 200 drives the punches 30 into the prescribed positions of the inner face of the circumferential wall 15, which are located on the opposite side of the second guide through-holes 72*b*, so as to bore two second through-holes 70*b*.

Figure 18A:
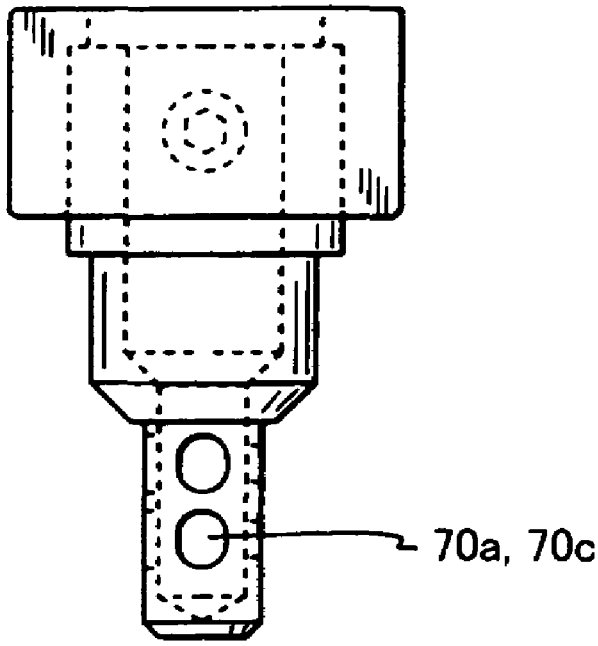
FIG. 18(*a*) is a plan view of the work piece, in which third through-holes are bored.
Figure 18B:
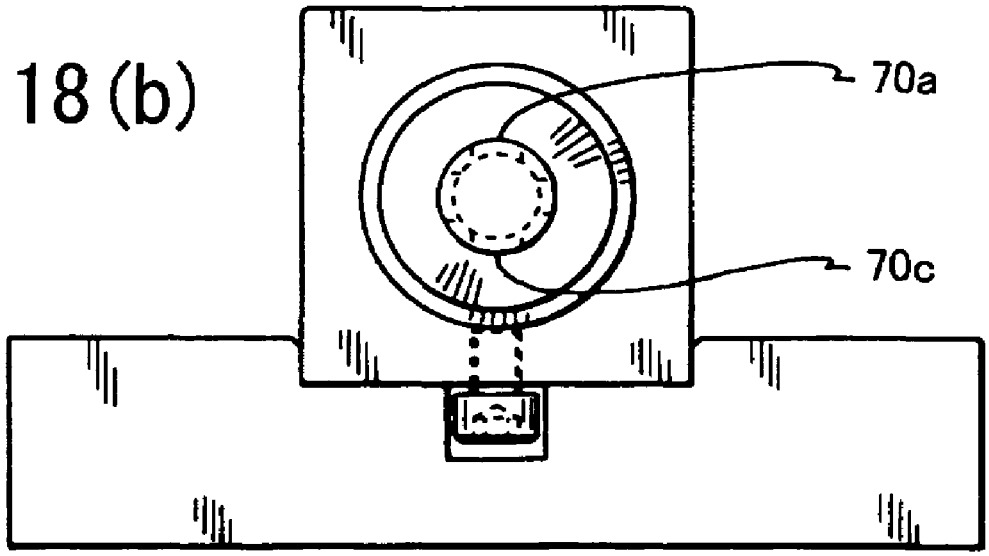

A fifth step is shown in FIGS. 18(*a*) and 18(*b*). The jig 16 is turned 90 degrees in the clockwise direction and fixed, then the second boring unit 200 drives the punches 30 into the prescribed positions of the inner face of the circumferential wall 15, which include the first guide through-holes 72*a*, so as to bore two third through-holes 70*c*. Therefore, the first guide through-holes 72*a* are disappeared by boring the third through-holes 70*c*.

Figure 19A:
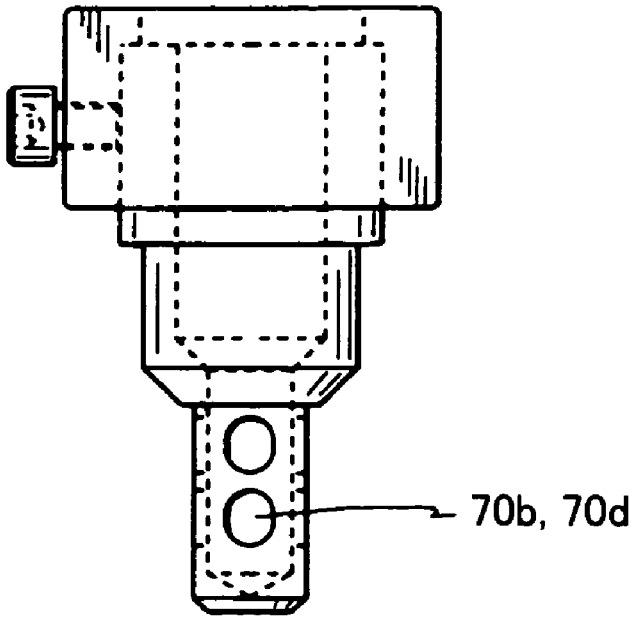
FIG. 19(*a*) is a plan view of the work piece, in which fourth through-holes are bored.
Figure 19B:
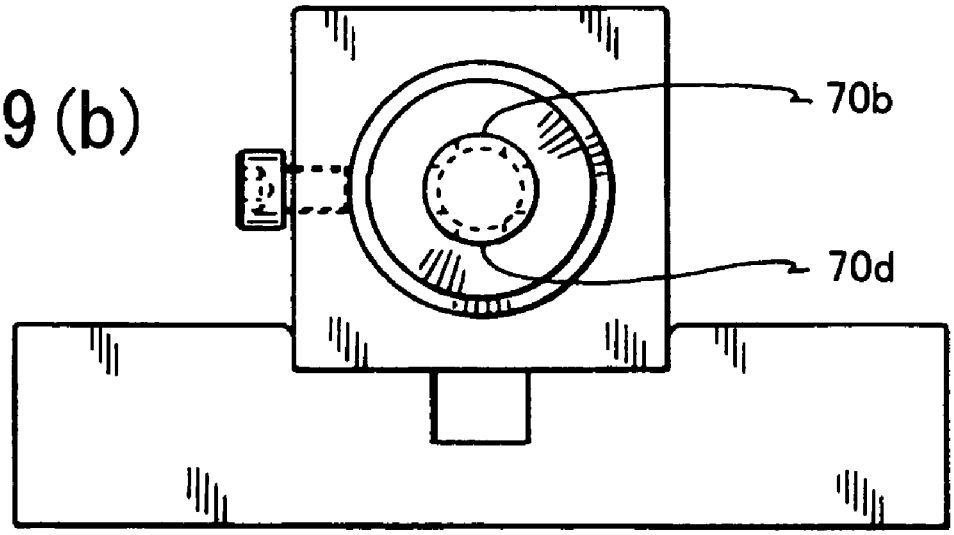
Figure 20A:
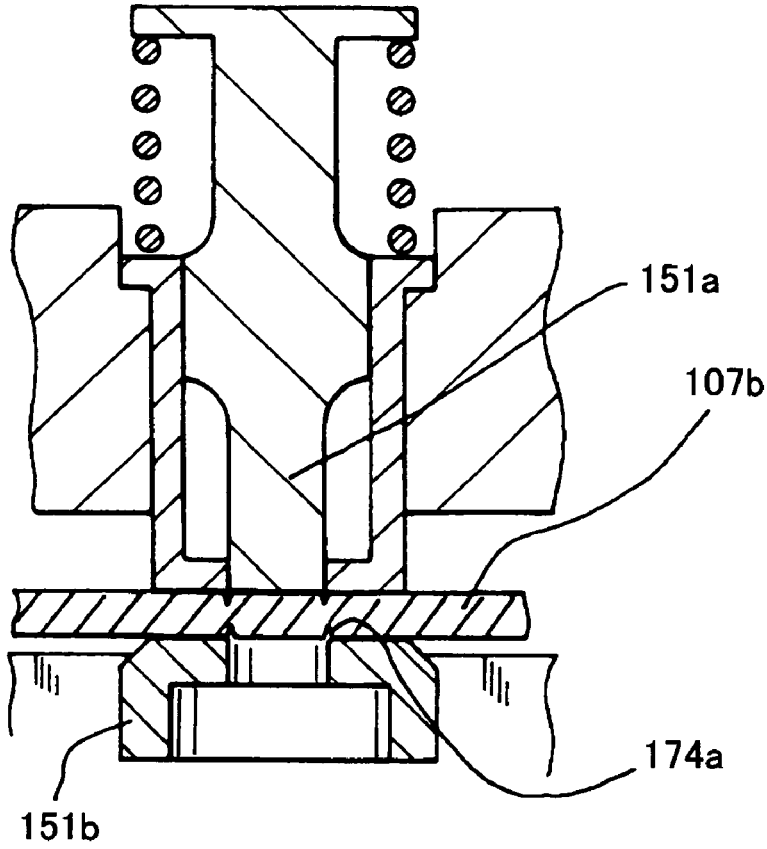
FIG. 20(a) PRIOR ART
FIGS. 20(*a*) and 20(*b*) are explanation views of the conventional through-hole forming machine.
Figure 20B:
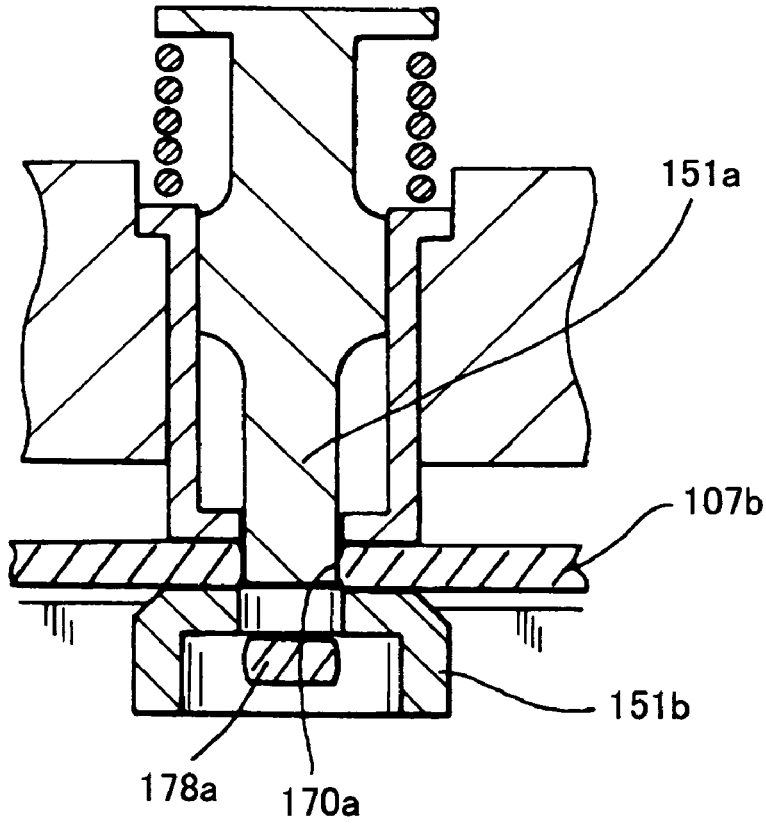
FIG. 20(b) PRIOR ART

A sixth step is shown in FIGS. 19(*a*) and 19(*b*). The jig 16 is turned 90 degrees in the clockwise direction and fixed, then the second boring unit 200 drives the punches 30 into the prescribed positions of the inner face of the circumferential wall 15, which include the second guide through-holes 72*b*, so as to bore two fourth through-holes 70*d*. Therefore, the second guide through-holes 72*b* are disappeared by boring the fourth through-holes 70*d*.

By executing the first to six steps, eight through-holes 70*a*, 70*b*, 70*c* and 70*d* can be efficiently formed. Manufacturing efficiency can be improved.

Note that, the shape of the through-hole is not limited to the above described embodiment. For example, circular, oval and elliptical through-holes may be bored by the present invention.

The invention may be embodied in other specific forms without departing from the spirit of essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A through-hole forming machine for forming a through-hole in a circumferential wall of a tubular part of a work piece by a punch-out press, comprising:

a die for holding the work piece, the die contacting an outer face of the circumferential wall of the tubular part at a prescribed position corresponding to the through-hole to be bored;

an elevating block which is movable in a punch-out direction;

a rod-shaped metal core having a free front end part, which is inserted into the tubular part of the work piece and moved in the punch-out direction, and a rear end part which is received by the elevating block which is located on an outer part of the tubular part of the work piece and moved in the punch-out direction;

a punch for punching out the through-hole with the die, the punch being fixed to and projected from the free front end part of the metal core and being inserted into the tubular part together with the free front end part of the metal core, whereby the punch faces a part of an inner wall face of the tubular part where the through-hole will be formed;

a press pin being inserted in the tubular part via a guide through-hole, which is formed in the circumferential wall of the work piece and which is located on the opposite side of the prescribed position, the press pin contacting a surface of the metal core, which is located on the opposite side of the punch; and a press plate mechanism for simultaneously pressing and moving the press pin and the elevating block which receives the metal core, for relatively pressing and moving the punch toward the die so as to drive the punch into an inner face of the circumferential wall by the metal core and bore the through-hole.

2. The machine according to claim 1, wherein the rear end part of the metal core is detachably attached to the elevating block.

3. The machine according to claim 1, wherein both corners of a front end face of the punch are obtusely chamfered along the inner face of the cylindrical wall of the tubular part of the work piece.

4. The machine according to claim 1, further comprising a mechanism for sucking a scrap, which is formed by boring the through-hole, via a discharge hole of the die.

5. A work piece having a tubular part and a through-hole formed in a circumferential wall of the tubular part, wherein the through-hole is formed by the machine of claim 1.

6. A work piece having a tubular part and a through-hole formed in a circumferential wall of the tubular part, wherein the through-hole is formed by the machine of claim 2.

7. A work piece having a tubular part and a through-hole formed in a circumferential wall of the tubular part, wherein the through-hole is formed by the machine of claim 3.

8. A work piece having a tubular part and a through-hole formed in a circumferential wall of the cylindrical part, wherein the through-hole is formed by the machine of claim 4.

* * * * *